US005515899A

United States Patent [19]

Chan

[11] Patent Number: 5,515,899

[45] Date of Patent: May 14, 1996

[54] EXPANSIBLE GATE

[76] Inventor: Yung-Neng Chan, 64, Lane 46, Syh-Wei Rd., Tou-Nan, Yun-Lin Hsien, Taiwan

[21] Appl. No.: 303,762

[22] Filed: Sep. 9, 1994

[51] Int. Cl.[6] ..... A47G 5/00

[52] U.S. Cl. ..... 160/135; 160/206; 52/71

[58] Field of Search ..... 160/135, 206, 160/159, 201; 49/386; 256/73; 52/65, 71

[56] References Cited

U.S. PATENT DOCUMENTS

| | | | |
|---|---|---|---|
| 2,987,782 | 6/1961 | Kurowski | 49/386 |
| 3,086,256 | 4/1963 | Schieber, Jr. | 52/71 X |
| 4,371,148 | 2/1983 | Harden | 256/73 X |
| 5,272,848 | 12/1993 | Maas | 160/135 X |

FOREIGN PATENT DOCUMENTS

| | | | |
|---|---|---|---|
| 157289 | 6/1939 | Germany | 160/206 |

*Primary Examiner*—Blair M. Johnson
*Attorney, Agent, or Firm*—Larson and Taylor

[57] ABSTRACT

An expansible gate comprising a plurality of frames and plate connecters continuously connected, all the frames and the connecters may be expanded to close the gate or to be collapsed to open the gate.

5 Claims, 5 Drawing Sheets

EXPANSIBLE GATE

BACKGROUND OF THE INVENTION

Conventional gates are commonly made in a factory according to the width of gates by measuring it before hand by workers and then transported to the site where it is to be installed. Generally, in production and installation, there exit some problems as: 1. no uniform size and shape to be prepared in advance; 2. heavy weight, unconvenient for installation; 3. much time needed in installation; and 4. impossibility of mass production.

SUMMARY OF THE INVENTION

The object of this invention is to provide a kind of expansible gate consisting of components of a uniform shape and size continuously connected together for adapting to any width of a passage of a factory, an institutional compound, a park, a museum, etc. And its installation is very simple to be carried out.

An expansible gate according to the present invention is consists of a plurality of frames and plate connecters of a uniform shape and size, with one frame connected with one plate connecter and then the plate connecters pivotally connected with each other continuously so that a plurality of the frames with the connecters may be combined together to meet the width of an entrance passage of a site. And the expansible gate can be expanded to close the entrance passage from a collapsed position wherein the gate is opened.

BRIEF DESCRIPTION OF DRAWINGS

This invention will now be described in detail with reference to accompanying drawings wherein.

DETAILED DESCRIPTION OF THE INVENTION

Figure 1:
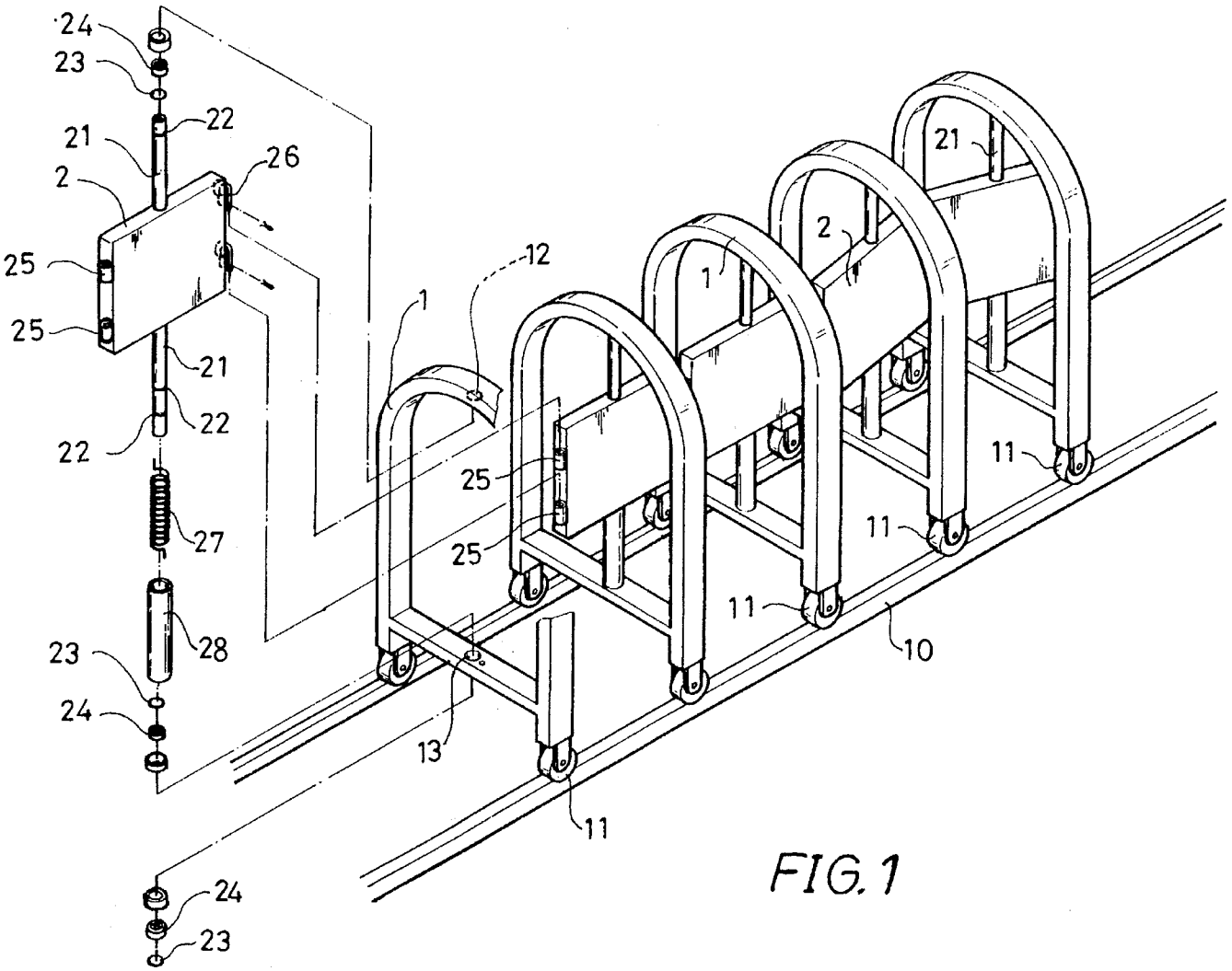
FIG. 1 is an exploded perspective view of an expansible gate in the present invention.

A preferred embodiment of an expansible gate in the present invention is shown in FIG. 1, comprising a plurality of frames 1 and connecters 2 continuously connected together.

Figure 5:
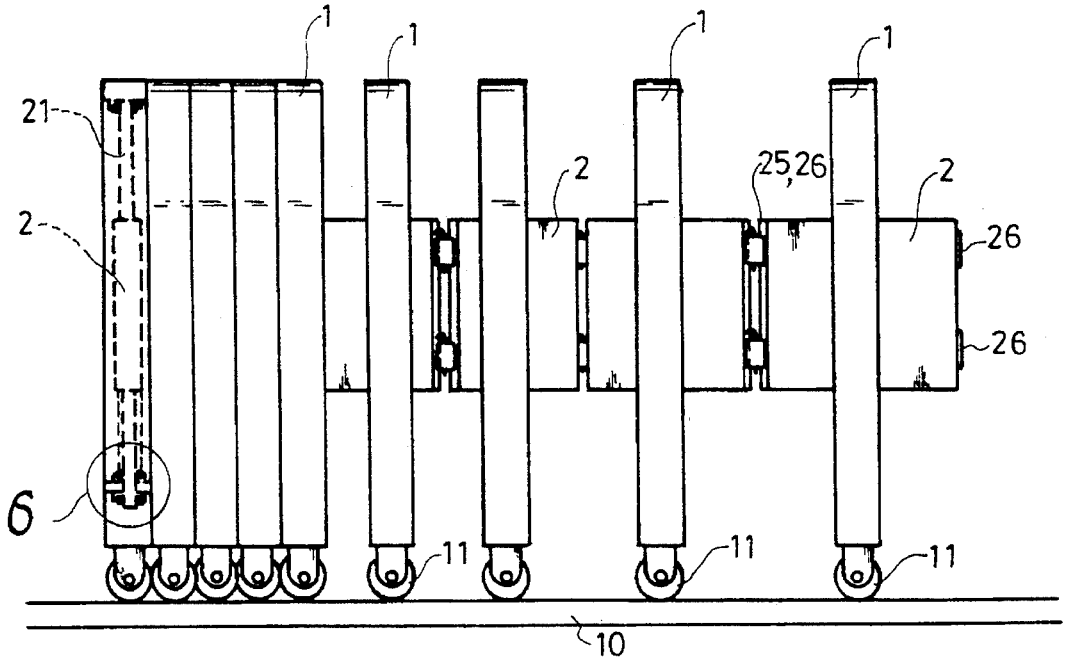
FIG. 5 is a front view of the expansible gate in the present invention, showing it in a half expanded position.
Figure 6:
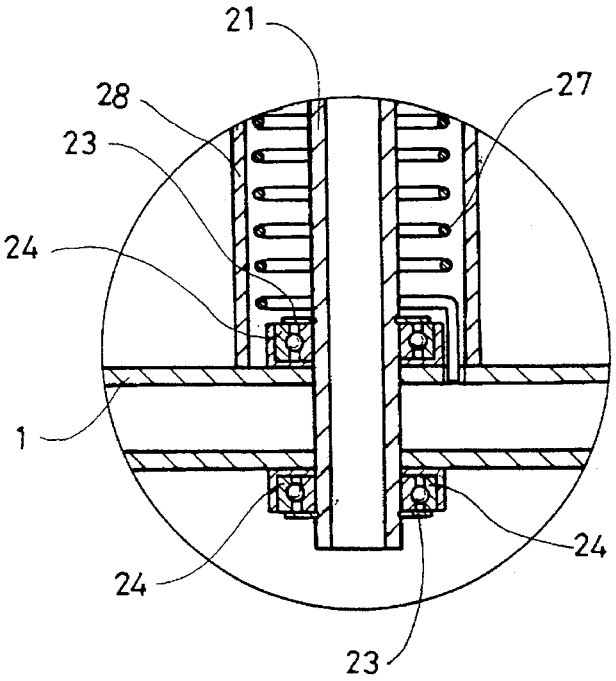
FIG. 6 is a cross-sectional view of the part marked 6 in FIG. 5.

Each frame 1 can be formed in various forms as needed, having an upper shaft hole 12, a lower shaft hole 13 for a shaft 21 of a connecter 2 to fit therein to enable the connecter 2 to swing around with the shaft 21 as a pivot to rotate in the two shaft holes 12, 13 as shown in FIGS. 5 and 6, and two rollers 11 at bottom to roll on two rails 10 for the frame 1 to move back and forth.

Each connecter 2 has an upper shaft 21 and a lower shaft 21 respectively extending up and down from the connecter body and having one or more annular grooves 22 in the upper and the lower shaft 21 for securing bearings 24 by positioning means 23 such as C-shaped rings so that the connecter 2 may be positioned between the upper and the lower shaft hole 12, and 13 to swing at the position. The connecter 2 also has two spaced rings 25 fixed at each of two vertical sides, and each pair of two related rings 25 of two abutting connecters 2 can be pivotally connected together with pivotal means 26 such as pins. When a plurality of the connecters 2 are to be collapsed after expanded, they can be folded or swung in the same direction. In addition, a coil spring 27 and a sleeve tube 28 may be provided around the lower shaft 21, with each spring 27 having an upper end fixed with the connecter 2 and a lower end fixed with the frame 1 to restore the connecter 2 to an original collapsed position by dint of elasticity of the spring 27 after all the frames 1 with the connecters 2 are expanded.

Figure 2:
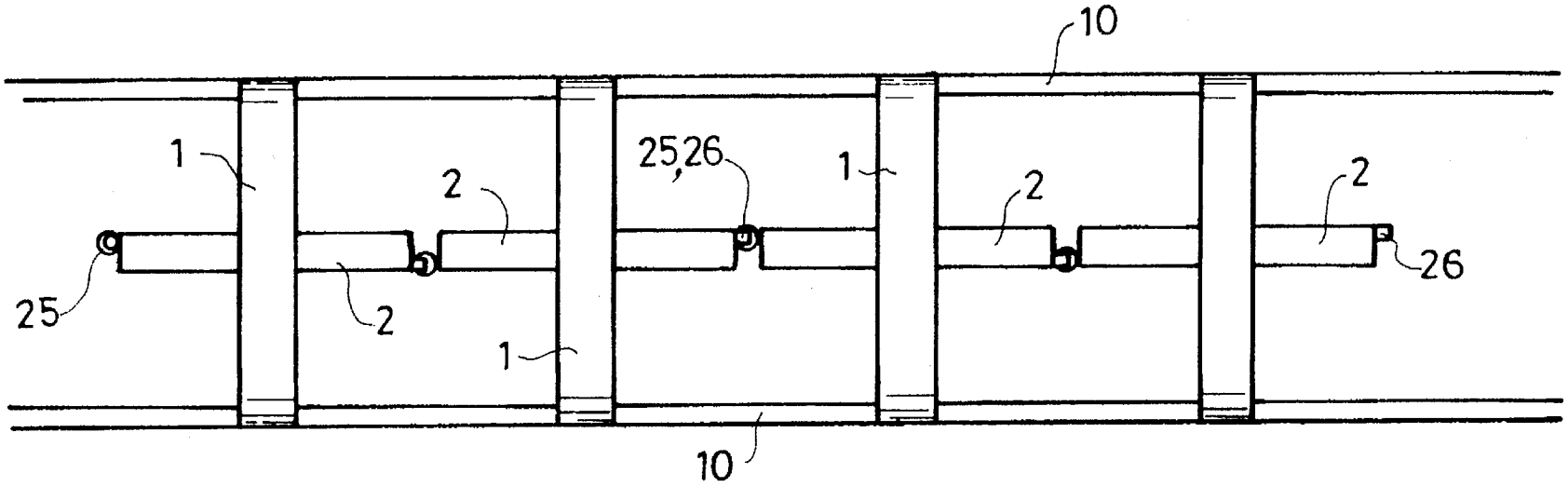
FIG. 2 is an upper view of the expansible gate in the present invention, showing it in an expanded position.
Figure 3:
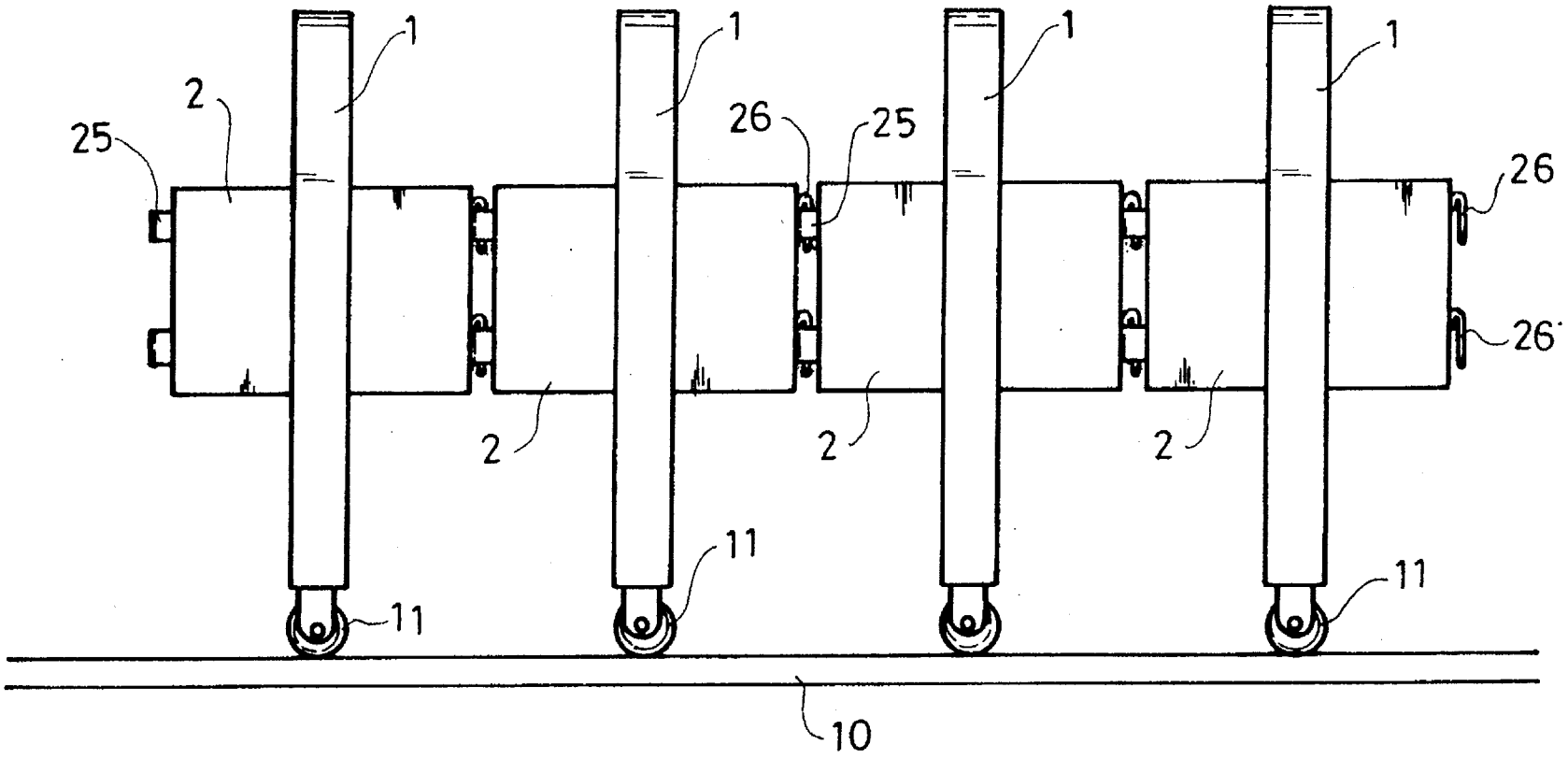
FIG. 3 is a front view of the expansible gate in the present invention, showing it in an expanded position.
Figure 4:
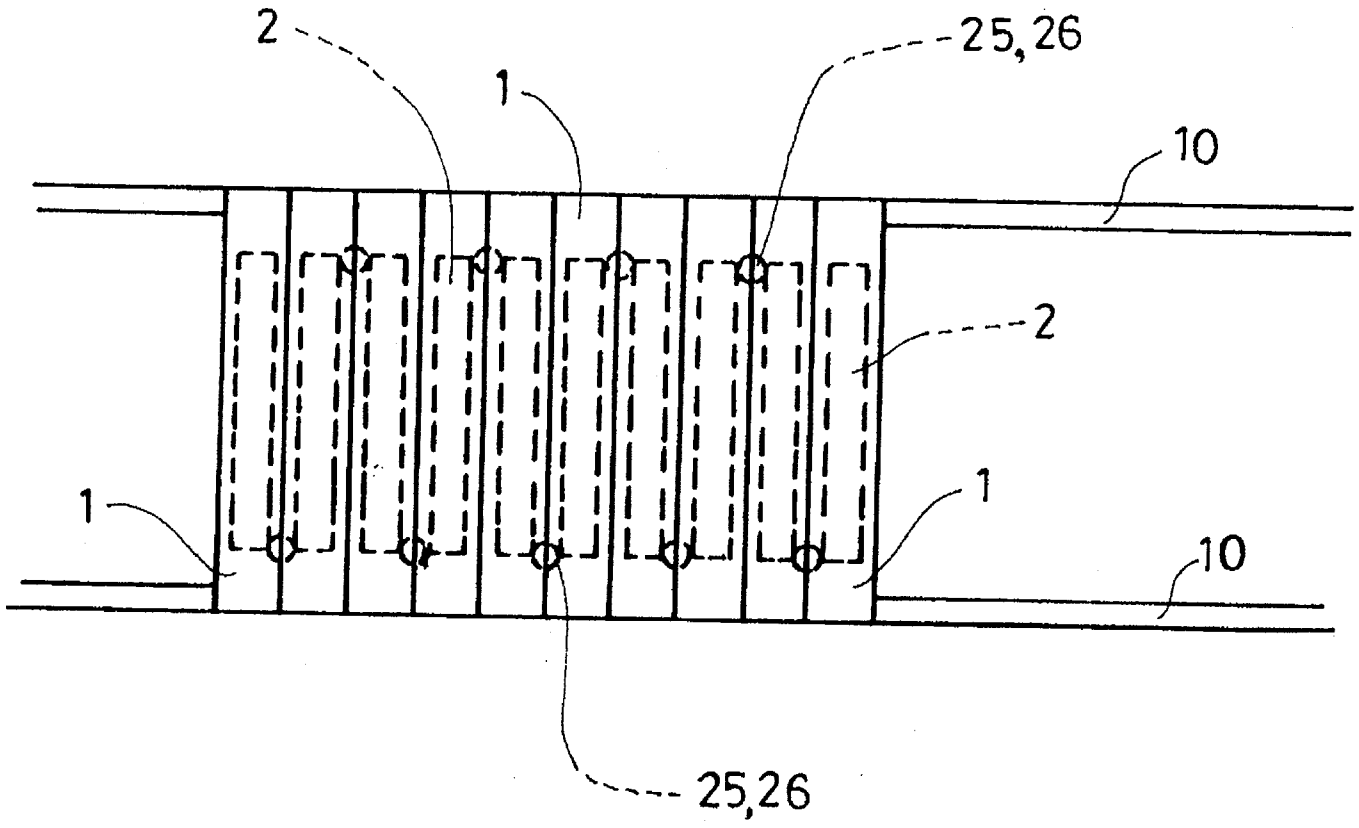
FIG. 4 is an upper view of the expansible gate in the present invention, showing it in a collapsed position.

FIGS. 2 and 3 show that a plurality of frames 1 continuously connected with a plurality of the connecters 2, standing on the two rails 10 and expanded to form a gate closing the entrance passage. If necessary, a driving means can be associated with the expansible gate to close and open it by electricity. After this gate is opened, all the frames 1 and the connecters 2 are collapsed to occupy a very small dimensions as shown in FIG. 4, guided by the pivotal means 26.

The structure of the expansible gate in the present invention makes it possible that its components, the frames 1 and the connecters 2 are manufactured in a uniform shape and size at a factory and then transported to a place where it is to be installed and then combined by workers, with lower cost and freight than other conventional gates.

What is claimed is:

1. An expansible gate comprising a plurality of frames having two lower rollers adapted to roll on two rails, each frame having an upper shaft hole and a lower shaft hole for an upper shaft and a lower shaft of a plate connector to fit and rotate therein inside the frame, and said plate connector having two vertical sides, one of said sides having two spaced rings and the other of said sides having pivotal means so that each pair of abutting plate connectors may be connected pivotally with each other by said pivotal means of one connector being pivotally connecting the rings of an abutting connected to.

2. The expansible gate as claimed in claim 1, wherein said upper shaft and said lower shaft of each of said connectors have at least one annular groove for positioning means to fix bearings on said upper shaft and said lower shaft in said shaft holes of each said frame to support said upper shaft and said lower shaft for rotation.

3. The expansible gate as claimed in claim 1, wherein said frames and said plate connectors are stored separately.

4. The expansible gate as claimed in claim 1, wherein one of said upper shaft and said lower shaft of each of said connectors is surrounded by a coil spring and a sleeve tube, each said spring having one end fixed with said frame and the other end fixed with the associated plate connector, each said spring having a coiling direction such that all of said plate connectors of the expansible gate may be swung around in the preset direction corresponding to the coiling direction of said springs.

5. The expandable gate as claimed in claim 1, wherein said pivotal means comprises a pivot pin.

* * * * *